US011512689B2

(12) United States Patent
Drevet et al.

(10) Patent No.: US 11,512,689 B2
(45) Date of Patent: Nov. 29, 2022

(54) UNDULATING-MEMBRANE FLUID CIRCULATOR

(71) Applicant: CorWave SA, Clichy (FR)

(72) Inventors: Jean-Baptiste Drevet, Paris (FR); Harold Guillemin, Seine-Port (FR)

(73) Assignee: CorWave SA, Clichy (FR)

( * ) Notice: Subject to any disclaimer, the term of this patent is extended or adjusted under 35 U.S.C. 154(b) by 58 days.

(21) Appl. No.: 16/762,909

(22) PCT Filed: Nov. 9, 2018

(86) PCT No.: PCT/EP2018/080749
§ 371 (c)(1),
(2) Date: May 8, 2020

(87) PCT Pub. No.: WO2019/092175
PCT Pub. Date: May 16, 2019

(65) Prior Publication Data

US 2021/0172429 A1 Jun. 10, 2021

(30) Foreign Application Priority Data

Nov. 10, 2017 (FR) ..... 1760583

(51) Int. Cl.
*F04B 43/00* (2006.01)
*F04B 43/04* (2006.01)

(52) U.S. Cl.
CPC ..... *F04B 43/0018* (2013.01); *F04B 43/0054* (2013.01); *F04B 43/04* (2013.01)

(58) Field of Classification Search
CPC ..... F04D 29/44; F04D 29/441; F04D 29/444; F04D 29/447; F04D 29/448; F04D 33/00; F04B 43/054; F04B 43/04
See application file for complete search history.

(56) References Cited

U.S. PATENT DOCUMENTS 2,842,067 A 7/1958 John et al.
3,107,630 A 10/1963 Johnson et al.
(Continued)

FOREIGN PATENT DOCUMENTS

AU 2013203301 A1 5/2013
AU 2013203301 B2 10/2015
(Continued)

OTHER PUBLICATIONS

Ando, et al., Electrocardiogram-Synchronized Rotational Speed Change Mode in Rotary Pumps Couldlmprove Pulsatility, Artificial Organs, 35(10):941-947 (2011).
(Continued)

*Primary Examiner* — Charles G Freay
(74) *Attorney, Agent, or Firm* — Eversheds Sutherland (US) LLP; Christopher C. Bolten; Robert D. Ward

(57) ABSTRACT

The present invention relates to an undulating-membrane fluid circulator having an intake port (3), a pump housing (4) delimiting a propulsion chamber (5), a discharge port (6), and an undulating membrane (2) paired with a drive means permitting an undulating movement of the membrane (2) between the upstream (8) and downstream (9) edges thereof, the undulating membrane (2) being capable of moving a fluid towards the discharge port (6). According to the invention, the circulator further comprises at least one means (7) for guiding the fluid, said means being disposed in the fluid propulsion chamber (5) near one of the edges (8, 9) of the undulating membrane (2) and making it possible to channel the fluid flow in a direction substantially parallel to the displacement of the wave along the membrane (2).

13 Claims, 3 Drawing Sheets

(56) References Cited

U.S. PATENT DOCUMENTS 3,165,061 A 1/1965 Smith et al.
3,608,088 A 9/1971 Dorman et al.
3,620,651 A 11/1971 Hufton
3,743,446 A 7/1973 Mandroian
3,765,175 A 10/1973 Ohnaka
4,063,826 A 12/1977 Riepe
4,277,706 A 7/1981 Isaacson
4,384,830 A 5/1983 Wakelin
4,484,095 A 11/1984 Neumann
4,488,854 A 12/1984 Miller
4,498,851 A * 2/1985 Kolm ..... F04D 33/00 310/331
4,648,807 A 3/1987 Tippetts et al.
4,753,221 A 6/1988 Kensey et al.
4,906,229 A 3/1990 Wampler
4,918,383 A 4/1990 Huff et al.
4,931,036 A 6/1990 Kanai et al.
4,939,405 A 7/1990 Okuyama et al.
4,955,856 A 9/1990 Phillips
4,995,857 A 2/1991 Arnold
5,147,388 A 9/1992 Yamazaki
5,263,978 A 11/1993 Kaufmann et al.
5,275,580 A 1/1994 Yamazaki
5,360,445 A 11/1994 Goldowsky
5,370,509 A 12/1994 Golding et al.
5,525,041 A 6/1996 Deak
5,588,812 A 12/1996 Taylor et al.
5,840,070 A 11/1998 Wampler
5,982,801 A 11/1999 Deak
6,030,336 A 2/2000 Franchi
6,058,593 A 5/2000 Siess
6,079,214 A 6/2000 Bishop
6,083,260 A 7/2000 Aboul-Hosn
6,116,862 A 9/2000 Rau et al.
6,123,725 A 9/2000 Aboul-Hosn
6,176,822 B1 1/2001 Nix et al.
6,176,848 B1 1/2001 Rau et al.
6,346,071 B1 2/2002 Mussivand
6,361,284 B2 3/2002 Drevet
6,395,026 B1 5/2002 Aboul-Hosn et al.
6,530,876 B1 3/2003 Spence
6,532,964 B2 3/2003 Aboul-Hosn et al.
6,658,740 B2 12/2003 Habben
6,659,740 B2 12/2003 Drevet
6,672,847 B2 1/2004 Dooley
6,723,039 B2 4/2004 French et al.
6,726,648 B2 4/2004 Kaplon et al.
6,732,501 B2 5/2004 Yu et al.
6,811,381 B2 11/2004 Dooley
6,848,001 B1 1/2005 Sakamoto et al.
6,935,344 B1 8/2005 Aboul-Hosn et al.
6,976,996 B1 12/2005 Aboul-Hosn
7,011,620 B1 3/2006 Siess
7,027,875 B2 4/2006 Siess et al.
7,182,727 B2 2/2007 Aboul-Hosn
7,323,961 B2 1/2008 Drevet
7,520,850 B2 4/2009 Brockway
7,696,634 B2 4/2010 Filardo
7,736,296 B2 6/2010 Siess et al.
7,839,007 B2 11/2010 Filardo
7,863,768 B2 1/2011 Filardo
7,889,877 B2 2/2011 Lutz
7,988,728 B2 8/2011 Ayre
8,012,079 B2 9/2011 Delgado, III
8,152,845 B2 4/2012 Bourque
8,157,720 B2 4/2012 Marseille et al.
8,167,593 B2 5/2012 Gohean et al.
8,333,686 B2 12/2012 Marseille et al.
8,343,029 B2 1/2013 Farnan et al.
8,366,401 B2 2/2013 Pate et al.
8,394,009 B2 3/2013 Bolyard et al.
8,394,010 B2 3/2013 Farnan
8,432,057 B2 4/2013 Filardo
8,449,444 B2 5/2013 Poirier
8,465,410 B2 6/2013 Marseille et al.
8,512,012 B2 8/2013 Akdis et al.
8,550,975 B2 10/2013 Foster
8,556,795 B2 10/2013 Bolyard et al.
8,562,508 B2 10/2013 Dague et al.
8,585,571 B2 11/2013 Bachman et al.
8,597,350 B2 12/2013 Rudser et al.
8,610,304 B2 12/2013 Filardo
8,714,944 B2 5/2014 Drevet
8,753,256 B2 6/2014 Bolyard et al.
8,784,291 B2 7/2014 Farnan et al.
8,821,366 B2 9/2014 Farnan et al.
8,821,527 B2 9/2014 Farnan et al.
8,827,888 B2 9/2014 Bolyard et al.
8,834,136 B2 * 9/2014 Drevet ..... F04B 43/0018 417/413.1
8,852,072 B2 10/2014 Larose et al.
8,870,739 B2 10/2014 Larose et al.
8,956,275 B2 2/2015 Bolyard et al.
8,976,546 B2 3/2015 Wang et al.
9,022,916 B2 5/2015 Farnan et al.
9,080,564 B2 7/2015 Drevet
9,089,635 B2 7/2015 Reichenbach et al.
9,144,669 B2 9/2015 Wieselthaler
9,145,875 B2 9/2015 Filardo
9,173,984 B2 11/2015 Larose et al.
9,211,367 B2 12/2015 Farnan et al.
9,308,304 B2 4/2016 Peters et al.
9,446,180 B2 9/2016 Vadala, Jr. et al.
9,526,819 B2 12/2016 Chen
9,572,915 B2 2/2017 Heuring et al.
9,579,437 B2 2/2017 Larose et al.
9,616,158 B2 4/2017 Yaghdjian
9,694,123 B2 7/2017 Bourque et al.
9,731,057 B2 8/2017 Garrigue
9,744,279 B2 8/2017 Tamez et al.
9,786,150 B2 10/2017 Kimball et al.
9,861,728 B2 1/2018 Farnan et al.
9,956,333 B2 5/2018 Larose et al.
9,968,720 B2 5/2018 Botterbusch et al.
10,166,319 B2 1/2019 Botterbusch et al.
10,188,779 B1 1/2019 Polverelli et al.
10,398,821 B2 9/2019 Botterbusch et al.
10,799,625 B2 10/2020 Scheffler et al.
10,933,181 B2 3/2021 Le Duc De Lillers et al.
11,097,091 B2 8/2021 Botterbusch et al.
2001/0001278 A1 5/2001 Drevet
2002/0095210 A1 7/2002 Finnegan et al.
2002/0146333 A1 10/2002 Drevet
2002/0165426 A1 11/2002 Sporer et al.
2003/0002325 A1 1/2003 Alvandpour et al.
2004/0002624 A1 1/2004 Yu et al.
2005/0031474 A1 * 2/2005 Zackl ..... F04B 43/09 417/461
2005/0261543 A1 11/2005 Abe et al.
2005/0288543 A1 12/2005 Stenberg et al.
2006/0014999 A1 1/2006 Heilman et al.
2006/0155158 A1 7/2006 Aboul-Hosn
2006/0288543 A1 12/2006 Lubera et al.
2007/0299297 A1 12/2007 Jarvik
2008/0232987 A1 * 9/2008 Drevet ..... F04B 43/02 417/478
2009/0082778 A1 3/2009 Beane et al.
2010/0234941 A1 9/2010 Finocchiaro et al.
2010/0241223 A1 9/2010 Lee et al.
2011/0124950 A1 5/2011 Foster
2011/0176945 A1 7/2011 Drevet
2011/0176946 A1 * 7/2011 Drevet ..... F04B 43/09 417/474
2011/0260449 A1 10/2011 Pokorney
2012/0089225 A1 4/2012 Akkerman et al.
2012/0220816 A1 8/2012 Peters et al.
2012/0323318 A1 12/2012 Yusuf et al.
2013/0042753 A1 2/2013 Becker et al.
2013/0078122 A1 3/2013 Drevet
2013/0178694 A1 7/2013 Jeffery et al.
2013/0267779 A1 10/2013 Woolford et al.
2013/0314047 A1 11/2013 Eagle et al.
2014/0023533 A1 1/2014 Ishii et al.
2014/0187852 A1 7/2014 Peters et al.

(56) References Cited

U.S. PATENT DOCUMENTS

| | | | |
|---|---|---|---|
| 2014/0207232 | A1 | 7/2014 | Garrigue |
| 2014/0275723 | A1 | 9/2014 | Fritz, IV et al. |
| 2014/0277423 | A1 | 9/2014 | Alkhatib et al. |
| 2014/0316426 | A1 | 10/2014 | Gollner et al. |
| 2015/0167659 | A1 | 6/2015 | Sauer |
| 2015/0330383 | A1* | 11/2015 | Letailleur ..... F04B 43/0054 417/472 |
| 2016/0038664 | A1 | 2/2016 | Callaway et al. |
| 2016/0051738 | A1 | 2/2016 | Callaway et al. |
| 2016/0235899 | A1 | 8/2016 | Yu et al. |
| 2016/0243294 | A1 | 8/2016 | Peters et al. |
| 2017/0012491 | A1 | 1/2017 | Schob et al. |
| 2017/0266358 | A1 | 9/2017 | Aber |
| 2017/0290966 | A1 | 10/2017 | Botterbusch et al. |
| 2017/0290967 | A1 | 10/2017 | Botterbusch et al. |
| 2017/0296723 | A1 | 10/2017 | Garrigue |
| 2018/0038364 | A1 | 2/2018 | Dumas et al. |
| 2018/0050143 | A1 | 2/2018 | Nguyen et al. |
| 2018/0256798 | A1 | 9/2018 | Botterbusch et al. |
| 2018/0369469 | A1 | 12/2018 | Le Duc De Lillers et al. |
| 2019/0125949 | A1 | 5/2019 | Botterbusch et al. |
| 2019/0381227 | A1 | 12/2019 | Botterbusch et al. |
| 2020/0368417 | A1 | 11/2020 | Polverelli et al. |
| 2021/0170160 | A1 | 6/2021 | Le Duc De Lillers et al. |
| 2021/0172429 | A1 | 6/2021 | Drevet et al. |

FOREIGN PATENT DOCUMENTS

| | | | |
|---|---|---|---|
| CA | 2712945 | A1 | 7/2009 |
| CN | 1257006 | A | 6/2000 |
| CN | 1355715 | A | 6/2002 |
| CN | 1714759 | A | 1/2006 |
| CN | 101472627 | A | 7/2009 |
| CN | 101878049 | A | 11/2010 |
| CN | 102112744 | A | 6/2011 |
| CN | 106421939 | A | 2/2017 |
| CN | 106489026 | A | 3/2017 |
| EP | 0412856 | A1 | 2/1991 |
| EP | 0415949 | A1 | 3/1991 |
| EP | 0445782 | B1 | 8/1994 |
| EP | 0925081 | B1 | 12/2003 |
| EP | 0961621 | B1 | 7/2004 |
| EP | 1551500 | A2 | 7/2005 |
| EP | 1233797 | B1 | 7/2006 |
| EP | 1337288 | B1 | 3/2008 |
| EP | 1981585 | A2 | 10/2008 |
| EP | 1644639 | B1 | 2/2009 |
| EP | 2152339 | A1 | 2/2010 |
| EP | 2249746 | A1 | 11/2010 |
| EP | 2310067 | A1 | 4/2011 |
| EP | 2600918 | A1 | 6/2013 |
| EP | 2517739 | B1 | 12/2013 |
| EP | 2704761 | A1 | 3/2014 |
| EP | 2310067 | B1 | 4/2014 |
| EP | 2753389 | A1 | 7/2014 |
| EP | 2152339 | B1 | 5/2015 |
| EP | 2891502 | A1 | 7/2015 |
| EP | 2704761 | B1 | 9/2015 |
| EP | 2736552 | B1 | 9/2015 |
| EP | 2891502 | B1 | 7/2016 |
| EP | 2164542 | B1 | 8/2016 |
| EP | 2856190 | B1 | 9/2016 |
| EP | 3145558 | A2 | 3/2017 |
| FR | 355700 | A | 11/1905 |
| FR | 2650862 | B1 | 11/1991 |
| FR | 2744769 | A1 | 8/1997 |
| FR | 2744769 | B1 | 2/1999 |
| FR | 2861910 | B1 | 1/2006 |
| FR | 2905147 | A1 | 2/2008 |
| FR | 3032917 | A1 | 8/2016 |
| GB | 662047 | A | 11/1951 |
| JP | 2011509801 | A | 3/2011 |
| KR | 20130068373 | A | 6/2013 |
| WO | WO-8910763 | A1 | 11/1989 |
| WO | WO-9008260 | A1 | 7/1990 |
| WO | WO-9729282 | A1 | 8/1997 |
| WO | WO-9959652 | A1 | 11/1999 |
| WO | WO-2007053881 | A1 | 5/2007 |
| WO | WO-2011056823 | A2 | 5/2011 |
| WO | WO-2016179262 | A1 | 11/2016 |
| WO | WO-2017087717 | A1 | 5/2017 |
| WO | WO-2017087785 | A1 | 5/2017 |
| WO | WO-2019092175 | A1 | 5/2019 |
| WO | WO-2020115607 | A2 | 6/2020 |

OTHER PUBLICATIONS

Ando, et al., Left ventricular decompression through a patent foramen ovale in a patient with hypertrophic cardiomyopathy: A case report, Cardiovascular Ultrasound, 2: 1-7 (2004).

Bozkurt, et al., Improving Arterial Pulsatility by Feedback Control of a Continuous Flow Left Ventricular Assist Device via in silico Modeling, International Journal of Artificial Organs, 37(10):773-785 (2014).

Castellanos, et al., Generations of Left Ventricular Assist Devices: The HeartMate Family, Dept. of Bioengineering. Florida Gulf Coast University, BME 3100C, pp. 1-6.

Crow, et al., Gastrointestinal Bleeding Rates in Recipients of Nonpulsatile and Pulsatile Left Ventricular Assist Devices, The Journal of Thoracic and Cardiovascular Surgery, 137(1):208-215 (2009).

Fatullayev, et al., Continuous-Flow Left Ventricular Assist Device Thrombosis: A Danger Foreseen is a Danger Avoided, Medical Science Monitor Basic Research, 21:141-144 (2015).

Feier, et al., A Novel, Valveless Ventricular Assist Device: The Fish Tail Pump. First Experimental in Vivo Studies, Artificial Organs, (26)12:1026-1031 (2002).

Fliess, et al., Flatness and Defect of Nonlinear Systems: Introductory Theory and Examples, International Journal of Control, 61(6):1327-1361 (1995).

Fraser et al., A Quantitative Comparison of Mechanical Blood Damage Parameters in Rotary Ventricular Assist Devices: Shear Stress, Exposure Time and Hemolysis Index, Journal of Biomechanical Engineering, 134(8):018002-1 to 018002-11 (2012).

Harris, et al., Ventricular Assist Devices, Continuing Education in Anesthesia, Critical Care & Pain, 12(3):145-151 (2012).

International Search Report & Written Opinion dated Mar. 4, 2019 in Int'l PCT Patent Appl No. PCT/IB2018/059199, 13 pages.

International Search Report & Written Opinion dated Aug. 22, 2017 in Int'l PCT Patent Application Serial No. PCT/IB2017/052069.

International Search Report & Written Opinion dated Jun. 28, 2017 in Int'l PCT Patent Application Serial No. PCT/IB2017/052068.

International Search Report & Written Opinion dated Jul. 15, 2020 in Int'l PCT Patent Appl. Serial No. PCT/IB2019/060144.

International Search Report and Written Opinion dated Apr. 16, 2019 in Int'l PCT Patent Appl. Serial No. PCT/EP2018/080749 (English Translation of ISR only).

International Search Report and Written Opinion dated Jun. 25, 2020 in International PCT Patent Application Serial No. PCT/1B2020/052337.

International Search Report and Written Opinion dated Aug. 3, 2018 in Int'l PCT Patent Appl. Serial No. PCT/IB2018/052215.

Ising, M., RPM and Flow Modulation for a Continuous Flow Left Ventricular Assist Device to Increase Vascular Pulsatility: A Computer Simulation, Mock Circulation, and In-Vivo Animal Study, Electronic Theses and Dissertations, University ofLouisville (2011).

Islam et al., Left Ventricular Assist Devices and Gastrointestinal Bleeding: A Narrative Review of Case Reports and Case Series, Clinical Cardiology, 36(4):190-200 (2013).

Jorde, et al., Identification and Management of Pump Thrombus in the HeartWare Left Ventricular Assist Device System, JACC: Heart Failure, 3(11):849-856 (2015).

Latham, et al., Parameter Estimation and a Series of Nonlinear Observers for the System Dynamics of a Linear Vapor Compressor, IEEE Transactions on Industrial Electronics, 63(11):6736-6744 (2016).

(56) References Cited

OTHER PUBLICATIONS

Leverett, et al., Red Blood Cell Damage by Shear Stress, Biophysical Journal, 12(3):257-273 (1972).
Malehsa, et al., Acquired von Willebrand Syndrome After Exchange of the HeartMate XVE to the HeartMate II Ventricular Assist Device, European Journal of Cardio-Thoracic Surgery, 35(6):1091-1093 (2009).
Mancini, et al., Left Ventricular Assist Devices, A Rapidly Evolving Alternative to Transplant, Journal of the American College of Cardiology, 653:2542-2555 (2015).
Mboup, et al., Numerical Differentiation With Annihilators in Noisy Environment, Numerical Algorithms, 50(4):439-467 (2009).
Menhour, et al., An Efficient Model-Free Setting for Longitudinal and Lateral Vehicle Control: Validation Through the Interconnected Pro-SiVIC/RTMaps Prototyping Platform, IEEE Transactions on Intelligent Transportation Systems, 19(2:461-475 (2018).
Mercorelli, P., A Motion-Sensorless Control for Intake Valves in Combustion Engines, IEEE Transactions on Industrial Electronics, 64(4):3402-3412 (2017).
Mercorelli, P., An Adaptive and Optimized Switching Observer for Sensorless Control of an Electromagnetic Valve Actuator in Camless Internal Combustion Engines, Asian Journal of Control, 16(4):959-973 (2014).
Mohite, et al., Does CircuLite Synergy Assist Device as Partial Ventricular Support have a Place in Modern Management of Advanced Heart Failure?, Expert Rev. Med. Devices, published online Dec. 2, 2014 (pp. 1-12).
Najjar, et al., An Analysis of Pump Thrombus Events in Patients in HeartWare Advance Bridge to Transplant and Continued Access Protocol Trial, The Journal of Heart and Lung Transplantation, vol. 33(1):23-34 (2014).
Pagani, Francis D., MD, PhD, Department of Cardiac Surgery, University of Michigan, "Technology 101: Review of Current Technologies, Types of Flow, Pump Parameters," American Association for Thoracic Surgery, Annual Meeting (2014), CardiothoracicTransplant and Mechanical Circulatory Support of Heart and Lung Failure.
Perschall, et al., The Progressive Wave Pump: Numerical Multiphysics Investigation of a Novel Pump Concept With Potential to Ventricular Assist Device Application, Artificial Organs, 35(9):E179-E190 (2012).
Rahman, et al., Position Estimation in Solenoid Actuators, IEEE Transactions on Industry Applications, 32(3):552-559 (1996).
Rigatos, G., Differential Flatness Theory ad Flatness-Based Control, in Nonlinear Control and Filtering Using Differential Flatness Approaches, 25(2):47-101 (2015).
Wang, et al., Rotary Blood Pump Control Strategy for Preventing Left Ventricular Suction, ASAIO Journal, 61(1):21-30(2015).
Wang., Quadrotor Analysis and Model Free Control with Comparisons, Universite Paris Sud—Paris XI, (2013).
Weidemann, Daniel., Thesis entitled, Permanent Magnet Reluctance Actuators for Vibration Testing, Completed at the Institute of Applied Mechanics, Technische Universitat Munchen, Apr. 2013.
Yuan, et al., The Spectrum of Complications Following Left Ventricular Assist Device Placement, Journal of Cardiac Surgery, 27:630-638 (2012).
Zhang, et al., Study on Self-Sensor of Linear Moving Magnet Compressor's Piston Stroke, IEEE Sensors Journal, 9(2):154-158 (2009).
U.S. Appl. No. 15/484,101 / U.S. Pat. No. 9,968,720 Botterbusch et al., filed Apr. 10, 2017 / May 15, 2018.
U.S. Appl. No. 15/484,108 / U.S. Pat. No. 10,166,319 Botterbusch et al., filed Apr. 10, 2017 / Jan. 1, 2019.
U.S. Appl. No. 15/940,856, filed Mar. 29, 2018.
U.S. Appl. No. 15/953,269 / U.S. Pat. No. 10,188,779 Polverelli et al., filed Apr. 13, 2018 / Jan. 29, 2019.
U.S. Appl. No. 15/976,831 / U.S. Pat. No. 10,398,821 Botterbusch et al., filed May 10, 2018 / Sep. 3, 2019.
U.S. Appl. No. 16/234,519, filed Dec. 27, 2018.
U.S. Appl. No. 16/557,711, filed Aug. 30, 2019.
U.S. Appl. No. 16/766,267, filed May 21, 2020.
U.S. Appl. No. 16/819,021, filed Mar. 13, 2020.
Extended European Search Report dated Aug. 25, 2021 in EP Patent Application Serial No. 21168340.4.
International Search Report & Written Opinion dated May 14, 2021 in Int'l PCT Patent Appl. Serial No. PCT/IB2021/051879.

* cited by examiner

UNDULATING-MEMBRANE FLUID CIRCULATOR

CROSS-REFERENCE TO RELATED APPLICATIONS

This application is a national phase application under 35 U.S.C. § 371 of PCT/EP2018/080749, filed Nov. 9, 2018, which claims priority to French patent application no. 1760583, filed Nov. 10, 2017, the entire contents of each of which are incorporated herein by reference.

FIELD OF THE INVENTION

The present invention relates to an undulating-membrane fluid circulator.

The invention can advantageously be used for the transportation of sensitive fluids, for example in the medical or food sector. However, although intended in particular for such applications, the circulator may also be used in other industrial or domestic applications.

BACKGROUND OF THE INVENTION

The patent FR 2 744 769 discloses the principle of an undulating-membrane fluid circulator, the circulator for example being able to take the form of a pump, fan, compressor or propulsion unit.

This type of circulator comprises a membrane that is made to undulate in a pump housing. The pump housing delimits a propulsion chamber for the fluid to be conveyed between an intake port and a discharge port. The membrane is activated by drive means, such as an actuator, connected to the membrane. The activation of the membrane causes same to undulate, in turn transmitting mechanical energy to the fluid so as to ensure the propulsion thereof.

This type of circulator has numerous advantages over other pump technologies, for example alternating-cycle volumetric pumps or peristaltic volumetric pumps. In particular, this type of circulator is suitable for transporting sensitive fluids and requires less space.

However, it appeared to the applicant that the structure in the application FR 2 744 769 is not optimal and, taking into account the movements of the fluid upstream and downstream of the membrane, that the effectiveness of the propulsion at the upstream and downstream edges of the membrane is reduced and, consequently, limits the hydraulic power of the circulator.

More specifically, the applicant has noted the existence of movements of the fluid in a direction transverse to the displacement of the wave along the membrane. These transverse movements at the edges of the membrane reduce the pressure differential existing in the propulsion chamber between the space located above the membrane and the space located below and, as a result, reduce the propulsion force of the upstream and downstream edges of the membrane.

The object of the present invention is to propose an improvement to the undulating-membrane fluid circulators described in the prior art.

OBJECT OF THE INVENTION

The object of the present invention is therefore to propose a circulator of which the structure makes it possible to maintain a significant pressure differential at the edges of the membrane, ensuring increased hydraulic power for the circulator while requiring the same amount of space.

SUMMARY OF THE INVENTION

To this end, the present invention relates to an undulating-membrane fluid circulator having at least one intake port, a pump housing delimiting a propulsion chamber, at least one discharge port, and a deformable membrane paired with a drive means for generating an undulating movement of the membrane between the upstream and downstream edges thereof (in this case, said undulating movement propagates from the upstream edge to the downstream edge), the undulating membrane being capable of moving a fluid towards the discharge port.

According to the invention, the circulator comprises a first means for guiding the fluid, said means being disposed in the fluid propulsion chamber near one of the edges of the undulating membrane and making it possible to channel the fluid flow in a direction substantially parallel to the displacement of the wave along the membrane.

For the purpose of clarifying the invention, the expression "near one of the edges of the undulating membrane" means "nearer one upstream or downstream edge of the membrane than to the other upstream or downstream edge of the membrane".

Therefore, the first means for guiding the fluid is nearer one of the edges of the membrane, in this case the upstream edge, than to the downstream edge.

The structure of the circulator according to the invention thus makes it possible to eliminate or at least limit, at least one edge of the membrane, the flows of fluid transverse to the displacement of the wave along the membrane.

Ideally, the baffle is a component separate from the membrane that may be in contact with the membrane or that is preferably at a distance from said membrane. Moreover, said baffle is preferably secured to the pump housing.

According to one preferred embodiment, the first guiding means is disposed near the upstream edge of the undulating membrane and a second guiding means is disposed near the downstream edge of the undulating membrane.

In this way, the difference in pressure between the space located above the membrane and the space located below is maintained at a high level over the entire surface of the membrane, thus ensuring increased hydraulic power for said membrane compared with previous devices.

Preferably, the first guiding means extends along the upstream edge while facing and being at a distance from said upstream edge.

Preferably, the second guiding means extends along the downstream edge while facing and being at a distance from said downstream edge.

The first guiding means is rigid and relatively non-deformable compared with the membrane, which is flexible and deformable.

On account of its rigidity, the first guiding means promotes laminar flows either side of the guiding means up to the region close to the upstream edge of the membrane, which reduces turbulence at the upstream edge and improves the fluid propulsion effectiveness of the undulating membrane.

Similarly, the second guiding means is rigid and relatively non-deformable compared with the membrane, which is flexible and deformable.

On account of its rigidity, the second guiding means promotes laminar flows either side of the guiding means, said laminar flow thus being promoted near the downstream edge of the membrane. This reduces turbulence at the downstream edge and improves the fluid propulsion effectiveness of the undulating membrane.

It is also possible for the first guiding means to be connected via a flexible connection to the upstream edge of the membrane, said first guiding means, together with the membrane and the flexible connection, forming a tight barrier between two different spaces of the propulsion chamber separated from one another by the membrane.

Said flexible connection prevents the fluid from flowing between the first guiding means and the upstream edge of the membrane, which further limits the sources of turbulence in the flow. This solution may, in certain cases, improve the effectiveness of the circulator.

Similarly, it is also possible for the second guiding means to be connected via a flexible connection to the downstream edge of the membrane, said second guiding means, together with the membrane and said flexible connection, forming a tight barrier between two different spaces of the propulsion chamber separated from one another by the membrane and the seconds guiding means.

Said flexible connection prevents the fluid from flowing between the second guiding means and the downstream edge of the membrane, which further limits the sources of turbulence in the flow. This solution may, in certain cases, improve the effectiveness of the circulator.

Preferably, the first guiding means comprises at least one baffle that preferably extends along the upstream edge of the membrane and in line with the membrane, when the membrane is viewed in a viewing direction perpendicular to a direction of flow that is substantially parallel to the displacement of the wave along the membrane.

Preferably, the second guiding means comprises at least one baffle that preferably extends along the downstream edge of the membrane and in line with the membrane, when the membrane is viewed in a viewing direction perpendicular to a direction of flow that is substantially parallel to the displacement of the wave along the membrane.

Therefore, in cases where the selected membrane has the tendency to extend in a membrane plane, the upstream baffle and/or the downstream baffle also extend(s) in a plane parallel to the membrane plane (see the examples in FIGS. 1 to 3 and 5 to 8). Conversely, in cases where the selected membrane forms a tube extending between the annular upstream and downstream edges thereof, an annular upstream baffle and/or an annular downstream baffle is/are provided (see the example in FIG. 4).

BRIEF DESCRIPTION OF THE DRAWINGS

The present invention will be better understood by reading the description of a detailed exemplary embodiment with reference to the appended drawings, provided by way of non-limiting example, in which.

DETAILED DESCRIPTION OF THE INVENTION

Figure 1:
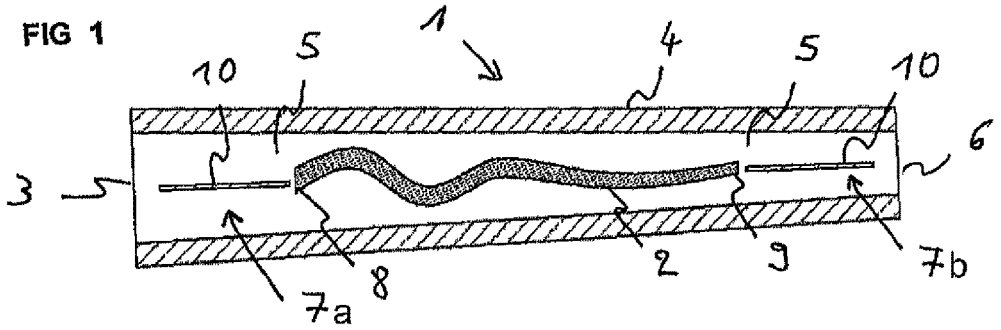
FIG. 1 is a schematic representation, in a side sectional view, of an exemplary embodiment of a fluid circulator, in this case longitudinal, according to a first example according to the invention.

With reference primarily to FIG. 1, a circulator 1 having a deformable undulating membrane 2 in the form of a longitudinal strip, a fluid intake port 3, a pump housing 4 delimiting a propulsion chamber 5, and a discharge port 6 is partially shown.

The undulating membrane 2 is paired with a drive means permitting an undulating movement of the membrane 2 between the upstream 8 and downstream 9 edges thereof, said drive means as well as the elements for connection to the membrane featuring in the application FR 2 744 769 and not being shown in the appended FIGS. 1 to 6 in order to make same easier to interpret. The drive means advantageously consists of an actuator connected directly or via a connection element to the upstream edge of the membrane 2.

By actuating the membrane 2, an undulation that propagates from the upstream edge 8 towards the downstream edge 9 of the membrane 2 can be created. The fluid is introduced into the propulsion chamber 5 via the intake port 3 and then moved towards the discharge port 6 by means of the undulations of the membrane 2.

In order to improve this transfer towards the discharge port 6, according to the invention, the circulator 1 is equipped with means 7 for guiding the fluid. FIG. 1 shows guiding means 7 disposed in the propulsion chamber 5 upstream of the undulating membrane 2.

Said guiding means 7 make it possible to channel the fluid flow in a direction substantially parallel to the displacement of the wave along the membrane 2.

The fluid arriving upstream of the membrane 2 is prevented from moving transversely to the displacement of the wave by the guiding means 7 and, consequently, the fluid cannot flow above or below the membrane 2 depending on the undulations thereof. In this way, the pressure differential created by the undulation is no longer compensated by a transverse transfer of fluid, as in the case of the circulator described in the document FR 2 744 769.

The pressure differential, which is therefore maintained, ensures good propulsion of the fluid by the part of the membrane near the upstream edge 8, which thus becomes effective. The hydraulic power generated by the circulator 1 is therefore increased.

According to an advantageous feature of the invention, guiding means 7 are also provided downstream of the membrane 2 close to the downstream edge 9 of the membrane 2.

The function of the guiding means 7 disposed downstream is the same as that of those located upstream of the membrane 2, i.e. making it possible to maintain a pressure differential by directing the fluid flow leaving the membrane 2, thus ensuring good propulsion of the fluid by the downstream edge 9. In this way, the entire membrane 2 is used effectively and the hydraulic power of the circulator 1 is increased.

In the preferred embodiment shown in the appended figures, the guiding means 7 comprise at least one baffle 10.

The baffle 10 is advantageously made of a flexible material, such that it not only guides the fluid but also promotes the propulsion thereof. Advantageously, means for stimulating the flexible baffle are provided, whereby the stimulation of the baffle 10 and of the membrane are in phase opposition to one another.

Nevertheless, a rigid baffle may be used in other embodiments.

In order to optimise the distribution of the fluid with respect to the membrane, the baffle or baffles 10 are disposed in parallel with the displacement of the wave along the membrane 2.

Nevertheless, the baffle 10 may also be slightly inclined in order to distribute the fluid differently between the space located above the membrane 2 and the space located below or in order to account for the position of the fluid intake port 3 or of the discharge port 6.

According to a feature of the invention, the baffle 10 is secured, directly or via connection elements, to the pump housing 4. Advantageously, the baffle 10 and the pump housing are integrally formed.

Figure 2:
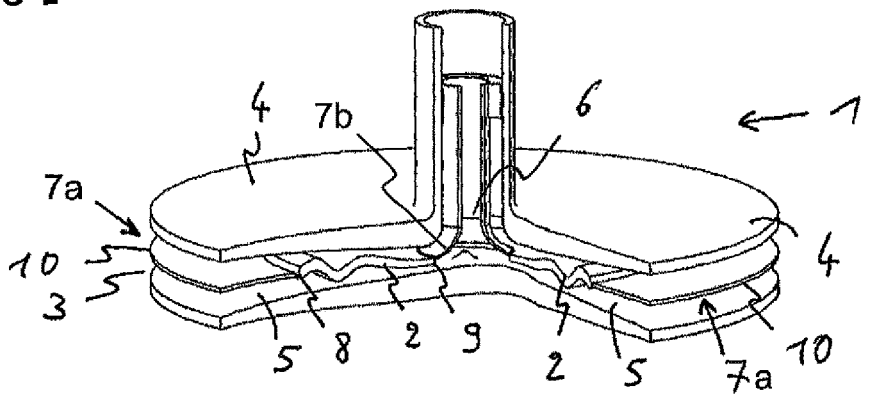
FIG. 2 is a schematic representation, in partial diametrical section, of a second exemplary embodiment of a fluid circulator, in this case circular, according to the invention.
Figure 3:
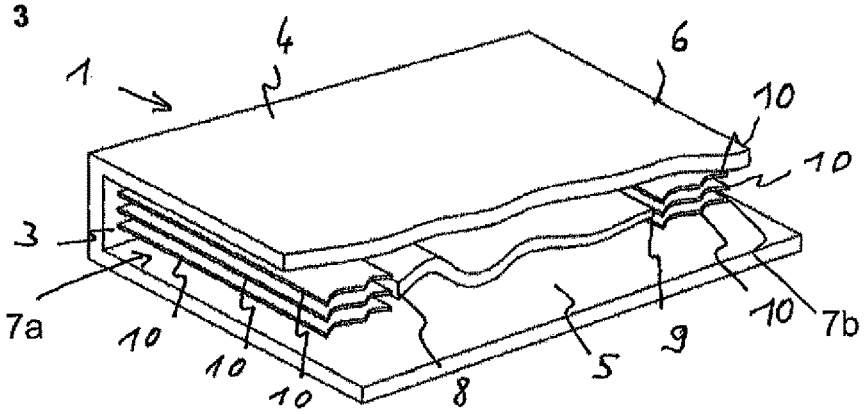
FIG. 3 is a schematic representation, in a partial sectional view, of a third exemplary embodiment of a fluid circulator, in this case longitudinal, according to the invention.

With reference to FIG. 2, a circular fluid circulator 1 is shown, this type of circulator comprising a pump housing 4 and an undulating membrane 2, said membrane being disc-shaped. In this exemplary embodiment, a first baffle 10 in the form of a ring surrounding the membrane 2 at the upstream edge 8 thereof as well as a second baffle 10 disposed between the discharge port 6 and the downstream edge 9 of the membrane can be seen. The baffles 10 operate in the same manner as those provided for the membrane 2 in the form of a longitudinal strip shown in FIG. 1.

It should be noted that, in other embodiments, at least two baffles 10 that are placed one above the other are provided upstream and/or downstream of the membrane 2. By way of example, with reference to FIG. 3, three baffles placed one above the other are shown. The use of a plurality of baffles 10 placed one above the other makes it possible to separate the main flow into a plurality of secondary fluid flows that flow one above the other and makes it possible to channel each of said flows in an improved manner in order to obtain laminar flows. This advantageous feature is particularly suitable if the cross-section of the propulsion chamber 5 is large in the region of the baffles.

Figure 4:
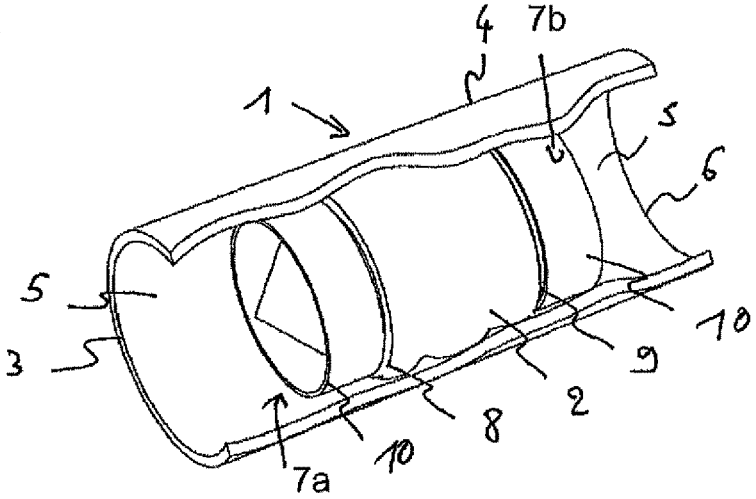
FIG. 4 is a schematic representation, in a side sectional view, of a fourth exemplary embodiment of a fluid circulator, in this case cylindrical, according to the invention.

With reference to FIG. 4, a third type of circulator 1, i.e. a cylindrical circulator in which the undulating membrane 2 is tubular, is shown. In this type of circulator, guiding means 7 are also provided in the form of cylindrical baffles 10 disposed upstream and downstream of the membrane 2.

In order to prevent transfer of fluid between the upstream baffle 10 and the upstream edge 8 of the undulating membrane 2 and between the downstream baffle 10 and the downstream edge 9 of the undulating membrane 2, the baffles 10 are disposed at a short distance from the edge of the undulating membrane 2, or from the support thereof connecting same to the actuator, advantageously less than one fiftieth of the length separating the upstream 8 and downstream 9 edges of the undulating membrane 2. In other words, the first guiding means 7*a* is disposed at a distance from the upstream edge of the membrane 2 of less than one fiftieth of the length separating the upstream 8 and downstream 9 edges. Similarly, the second guiding means 7*b* may be disposed at a distance from the downstream edge 9 of the membrane 2 of less than one fiftieth of the length separating the upstream 8 and downstream 9 edges.

Nevertheless, in other embodiments, baffles that are further from the edges of the undulating membrane 2 may be used.

Figure 5:
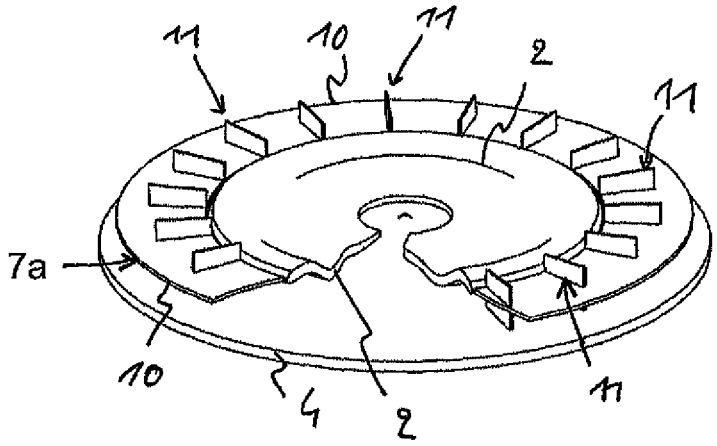
FIG. 5 is a perspective view of a first alternative embodiment of an element of the invention.

With reference to FIG. 5, an alternative embodiment of a circulator 1 is shown. This variant comprises complementary guiding means 11, said complementary guiding means 11 being disposed in a plane perpendicular to a plane in which the first guiding means 7*a* extends and making it possible to prevent a circular motion of the fluid between the intake port 3 and the undulating membrane 2.

In another embodiment (not shown), complementary guiding means 11 can also be disposed in a plane perpendicular to a plane in which the second guiding means 7*b* extends and they can also make it possible to prevent a circular motion of the fluid between the discharge port and the undulating membrane 2.

As in the case of the guiding means 7*a*, 7*b*, the complementary guiding means 11 make it possible to increase the hydraulic power of the circulator 1.

According to a particular feature, the complementary guiding means 11 are, as shown in FIG. 5, fastened to the first guiding means 7*a*; advantageously, the first guiding means 7*a* and the complementary guiding means 11 are integrally formed.

Other features of the invention could also be envisaged without going beyond the scope of the invention defined in the claims below.

Therefore, by way of example, in the different examples included in the description the guiding means 7*a*, 7*b* each consist of baffles 10, but in other embodiments different devices could be used to guide the flow, in particular by providing two separate flow inlets, each oriented towards the space above or below the membrane.

Figure 6:
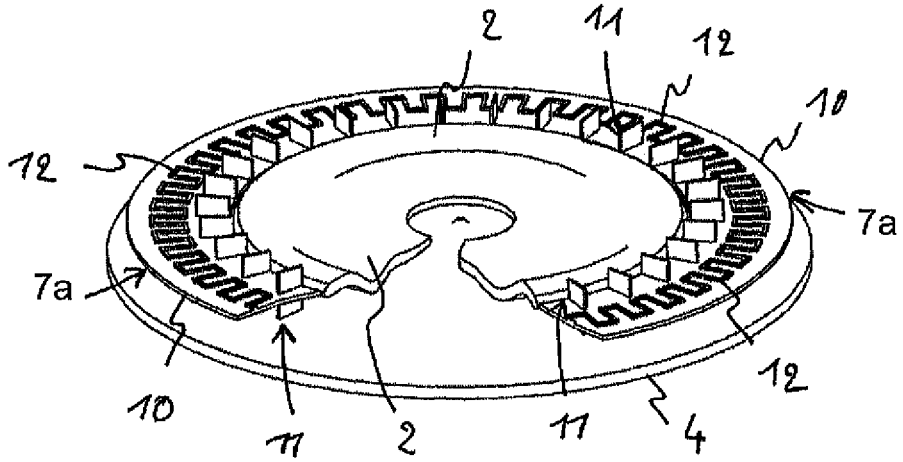
FIG. 6 is a perspective view of a second alternative embodiment of an element of the invention.

In another embodiment, the guiding means 7*a* and/or 7*b* comprise heat transfer elements that make it possible to vary the fluidity of the fluid to be pumped and/or the temperature thereof. This embodiment of the guiding means is shown in FIG. 6, with heating elements 12 supported by the first guiding means. This example also features complementary guiding means 11 that also perform the function of heat diffusers, since they extend from the guiding means supporting the heating elements 12. Of course, the heat transfer elements supported by the guiding means 7*a* in this case comprise the heating means 12, but they may also comprise cooling means and/or a coolant circuit.

Figure 7:
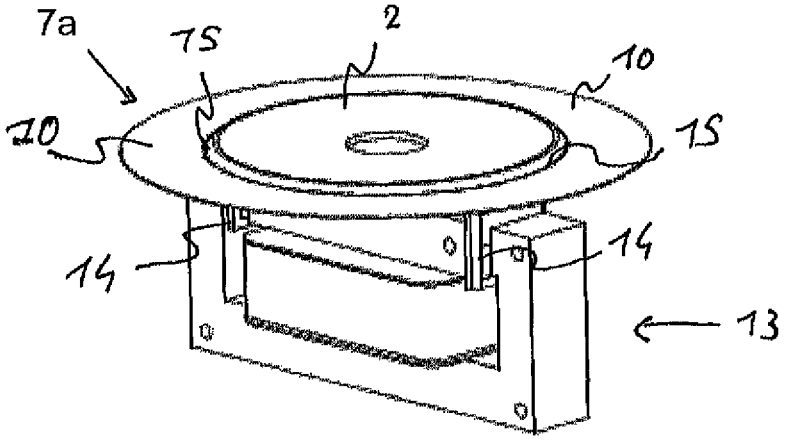
FIG. 7 is a perspective view of a fifth example of a fluid circulator.

In another embodiment shown in FIG. 7, the guiding means 7 are not connected to the pump housing 4 but are secured between the drive means 13 of the membrane and the membrane 2 itself. Accordingly, the first guiding means 7*a* is connected to a movable portion 14 of the drive means 13 via a spring-loaded connection, such that the first guiding means is guided in an elastically deformable manner relative to the movable portion 14.

By connecting a guiding means 7*a* or 7*b* via a spring-loaded connection to the drive means 13 and, more specifically, to the movable portion 14 of the drive means 13, the movable portion 14 is both guided and cushioned by the guiding means 7*a* or 7*b*, which is immersed in the fluid. In order to do this, the first guiding means 7*a* consists of a baffle 10 in the form of a crown and comprising cut-outs 15 in the region of the connection to the movable portion 14 so as to give the connection the effect of a spring.

Figure 8:
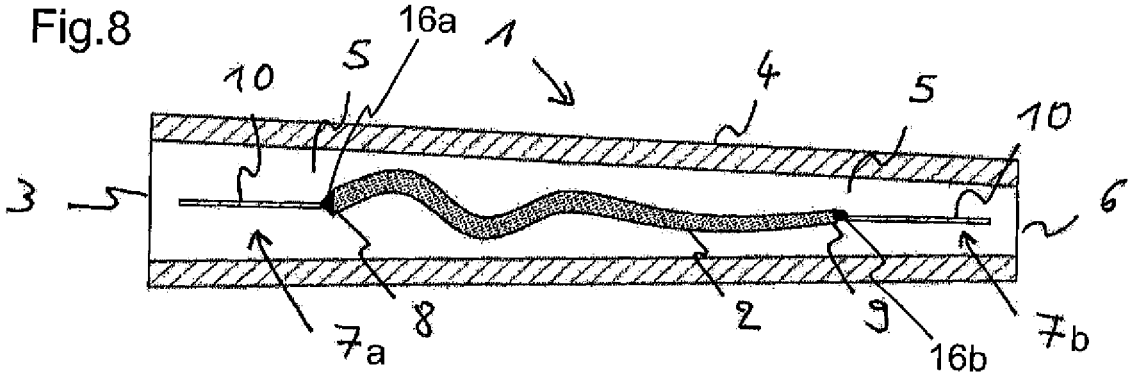
FIG. 8 is a schematic representation, in partial diametrical section, of another exemplary embodiment of a fluid circulator.

In another embodiment shown in FIG. 8, the first guiding means 7*a* may be connected via a flexible connection 16*a* to the upstream edge 8 of the membrane 2, said first guiding means 7*a*, together with the membrane 2 and the flexible connection 16, forming a tight barrier between two different spaces of the propulsion chamber 5.

In another embodiment shown in FIG. 8, the second guiding means 7*b* may also be connected via a second flexible connection 16*b* to the downstream edge 9 of the membrane 2, said second guiding means 7*b*, together with the membrane 2 and the second flexible connection 16*b*, forming a tight barrier between two different spaces of the propulsion chamber 5 separated from one another by the membrane 2.

In other words, in the embodiment shown in FIG. 8, the guiding means 7*a*, 7*b* and the upstream 8 and downstream 9 edges of the membrane are connected to one another by first and second flexible connections 16*a*, 16*b*, respectively, making it possible to form a seal between the portion of the propulsion chamber located above the membrane and the portion located below. In this way, transverse flows of fluid between said two portions/spaces of the chamber are prevented during displacement of the wave along the membrane 2.

The invention claimed is:

1. An undulating-membrane fluid circulator comprising:

at least one intake port, a pump housing delimiting a propulsion chamber, at least one discharge port, and a deformable membrane paired with an actuator configured to generate an undulating movement of the deformable membrane between a first edge and a second edge, the deformable membrane configured to undulate in a wave-like manner and move a fluid towards the discharge port, wherein the fluid circulator comprises a first guiding structure disposed in the fluid propulsion chamber coupled to an edge of the deformable membrane, wherein the first guiding structure is configured to guide the fluid from a first direction substantially parallel to the deformable membrane to a second direction perpendicular to the first direction, and wherein the first guiding structure is positioned between the deformable membrane and at least a portion of the actuator.

2. The fluid circulator according to claim 1, wherein the fluid circulator comprises a second guiding structure, wherein the first guiding structure is disposed near a first edge of the deformable membrane and wherein the second guiding structure is disposed near a second edge of the deformable membrane.

3. The fluid circulator according to claim 2, wherein the first guiding structure comprises a baffle.

4. The fluid circulator according to claim 3, wherein the baffle is flexible.

5. The fluid circulator according to claim 3, wherein the baffle is disposed substantially parallel to the deformable membrane.

6. The fluid circulator according to claim 2, wherein the second guiding structure is elastically connected to a movable portion of the actuator, such that the second guiding structure is guided in an elastically deformable manner relative to the movable portion.

7. The fluid circulator according to claim 2, wherein the second guiding structure comprises a baffle and the baffle is secured to the pump housing.

8. The fluid circulator according to claim 1, wherein the first guiding structure comprises at least one heat transfer element that is capable of varying the temperature of the fluid.

9. The fluid circulator according to claim 1, wherein the first guiding structure is disposed at a distance from the first or second edge of the deformable membrane of less than one fiftieth of a length separating the first and second edges of the deformable membrane.

10. The fluid circulator according to claim 1, wherein the fluid circulator comprises a second guiding structure connected via a flexible connection to the first edge or the second edge of the deformable membrane, the second guiding structure, together with the deformable membrane and the flexible connection, forming a tight barrier between two different spaces of the propulsion chamber separated from one another by the deformable membrane.

11. An undulating-membrane fluid circulator comprising:

at least one intake port, a pump housing delimiting a propulsion chamber, at least one discharge port, and a deformable membrane paired with a drive configured to generate an undulating movement of the deformable membrane between a first edge and a second edge, the deformable membrane configured to undulate in a wave-like manner and move a fluid towards the discharge port, wherein the fluid circulator comprises a first guiding structure configured to guide the fluid disposed in the fluid propulsion chamber, coupled to an edge of the deformable membrane, positioned between at least a portion of the drive and the deformable membrane, and configured to cause the fluid to transition from a first direction to a second direction different than the first direction and substantially parallel to the deformable membrane.

12. The fluid circulator according to claim 11, further comprising a second guiding structure disposed in the fluid propulsion chamber, wherein the first guiding structure is disposed near a first edge of the deformable membrane and wherein the second guiding structure is disposed near a second edge of the deformable membrane.

13. The fluid circulator according to claim 11, wherein the second guiding structure comprises a baffle.

* * * * *